US011850489B2

(12) United States Patent
Fazio

(10) Patent No.: US 11,850,489 B2
(45) Date of Patent: Dec. 26, 2023

(54) TRAINING PAD

(71) Applicant: Raimondo Fazio, Northbridge (AU)

(72) Inventor: Raimondo Fazio, Northbridge (AU)

(73) Assignee: Raimondo Fazio, Northbridge (AU)

( * ) Notice: Subject to any disclaimer, the term of this patent is extended or adjusted under 35 U.S.C. 154(b) by 236 days.

(21) Appl. No.: 17/299,604

(22) PCT Filed: Dec. 5, 2019

(86) PCT No.: PCT/AU2019/051333
§ 371 (c)(1),
(2) Date: Jun. 3, 2021

(87) PCT Pub. No.: WO2020/113277
PCT Pub. Date: Jun. 11, 2020

(65) Prior Publication Data

US 2022/0016507 A1 Jan. 20, 2022

(30) Foreign Application Priority Data

Dec. 6, 2018 (AU) ..... 2018904645
Aug. 19, 2019 (AU) ..... 2019903003

(51) Int. Cl.
*A63B 69/26* (2006.01)
*A63B 69/22* (2006.01)
(Continued)

(52) U.S. Cl.
CPC ..... *A63B 69/26* (2013.01); *A63B 21/285* (2013.01); *A63B 69/224* (2022.08);
(Continued)

(58) Field of Classification Search
CPC ..... A63B 21/285; A63B 69/26; A63B 69/224; A63B 69/20; A63B 69/22; A63B 69/24;
(Continued)

(56) References Cited

U.S. PATENT DOCUMENTS 2,591,523 A * 4/1952 Dick ..... B62K 21/26 74/551.8
4,214,751 A * 7/1980 Simpson ..... A63B 59/50 473/457

(Continued)

OTHER PUBLICATIONS

International Search Report and Written Opinion from PCT Application No. PCT/AU2019/051333, dated Feb. 18, 2020.

(Continued)

*Primary Examiner* — Megan Anderson
(74) *Attorney, Agent, or Firm* — WORKMAN NYDEGGER

(57) ABSTRACT

A training pad is provided including a flexible resilient shaft having a first end and a second end. A handle portion is provided adjacent the first end of the shaft and a padded member is mounted adjacent the second end of the shaft. A guard is provided having a first end connected to the first end of the shaft and a second end connected to the shaft on a side of the handle portion adjacent the padded member. The guard includes a flexible resilient member being curved between the first and second ends thereof such that the guard defines a convex outer surface supported in front of the handle portion.

10 Claims, 5 Drawing Sheets

(51) Int. Cl.
*A63B 21/28* (2006.01)
*A63B 71/00* (2006.01)
*A63B 71/14* (2006.01)

(52) U.S. Cl.
CPC ..... *A63B 71/0054* (2013.01); *A63B 71/14* (2013.01); *A63B 2071/009* (2013.01); *A63B 2209/14* (2013.01); *A63B 2244/102* (2013.01)

(58) Field of Classification Search
CPC ..... A63B 71/00054; A63B 71/14; A63B 2071/009; A63B 2209/14; A63B 2244/102
See application file for complete search history.

(56) References Cited

U.S. PATENT DOCUMENTS 4,423,868 A * 1/1984 Younts ..... A63B 60/06 30/295
4,493,494 A 1/1985 Feagin, Jr.
5,325,997 A * 7/1994 Washington ..... F41H 9/10 224/218
7,458,921 B2 * 12/2008 Hallar ..... A63B 21/0726 482/106
8,777,631 B1 7/2014 Fletcher
8,814,758 B1 * 8/2014 Mattox ..... A63B 71/14 482/141
9,364,734 B1 * 6/2016 Dixon, Jr. ..... A63B 71/0622
9,776,061 B2 * 10/2017 Nussbaum ..... A63B 69/26
2014/0148313 A1 5/2014 Orlando
2014/0336014 A1 11/2014 Francis
2015/0013041 A1 1/2015 McBride
2015/0306484 A1 10/2015 Nussbaum

OTHER PUBLICATIONS

Australian Search Report from corresponding AU Application No. 2019903003, dated Oct. 14, 2019.

* cited by examiner

TRAINING PAD

FIELD OF THE INVENTION

The present invention relates to a pad which may be used for training in combat sports such as boxing.

BACKGROUND TO THE INVENTION

Many combat sports utilise pads for training. The pads may be held by a trainer and moved around while the participant punches the pad. Two common types of pads used for this purpose are focus pads and paddles. Focus pads generally comprise round pads with a pocket on the back, into which the trainer can insert their hand. The trainer then holds the padded side towards the fighter, who strikes the pad with punches. A common problem with such focus pads is that the force of the repeated blows can be damaging to the arm joints of the trainer, such as shoulders and fingers.

Paddles comprise a small round pads secured to the end of a short handle. The handle is held outwardly such that the face of the pad is directed towards the fighter. As the fighter strikes the pad, the pad and the end of the handle may be pushed backwardly, thereby reducing the impact force on the arm of the trainer. A common problem with such paddles however is that the fighter may miss the pad and strike towards the front surface of the handle, thereby striking the hand or wrist of the trainer. This can result in injury to both the training and the fighter.

The present invention relates to a pad for training combat sports which seeks to address the abovementioned problems, while being sufficiently strong to withstand the type of impacts expected during training.

SUMMARY OF THE INVENTION

According to one aspect of the present invention there is provided a training pad comprising:

- a flexible resilient shaft having a first end and a second end;
- a handle portion provided adjacent the first end of the shaft;
- a padded member mounted adjacent the second end of the shaft; and
- a guard having a first end connected to the first end of the shaft and a second end connected to the shaft on a side of the handle portion adjacent the padded member;
- wherein the guard comprises a flexible resilient member being curved between the first and second ends thereof such that the guard defines a convex outer surface supported in front of the handle portion.

Preferably shaft comprises a spring and a rod received into an end of the spring, the spring including a handgrip such that the spring and the handgrip form the handle portion.

Preferably the padded member includes a first side surface adjacent the shaft and a second side surface to be struck with blows in use and the rod includes a bend located on a side of the padded member adjacent the spring such that a portion of the shaft from the bend to the first end is bent in a direction towards the second side surface.

Preferably a plate is connected to the rod such that the first side surface of the padded member is connected to the plate.

In a preferred embodiment, the second end of the guard includes a hole through which the shaft is received and the plate includes a slot on a side adjacent the handle portion such that the second end of the guard passes through the slot.

Preferably the guard comprises a shield portion located in front of the handle portion, a first support extending from the shield portion to connect to the first end of the shaft and a second support extending from the shield portion to connect to the shaft adjacent the padded member.

Preferably first support comprises an elongate planar member extending at an angle to the shield portion to a position adjacent the first end of the shaft such that a distal end of the first support is secured to the first end the shaft by a fastener received into a plug provided in an end of the spring.

Preferably the second support comprises an elongate planar member extending at an angle to the shield portion from a second end thereof to be adjacent the shaft.

In a preferred embodiment, the shield portion and the first and second supports are integrally formed.

Preferably the pad includes a rear padded member secured to a second side surface of the plate.

BRIEF DESCRIPTION OF THE DRAWINGS

The invention will now be described, by way of example, with reference to the following drawings, in which.

DETAILED DESCRIPTION OF PREFERRED EMBODIMENTS

Figure 1A:
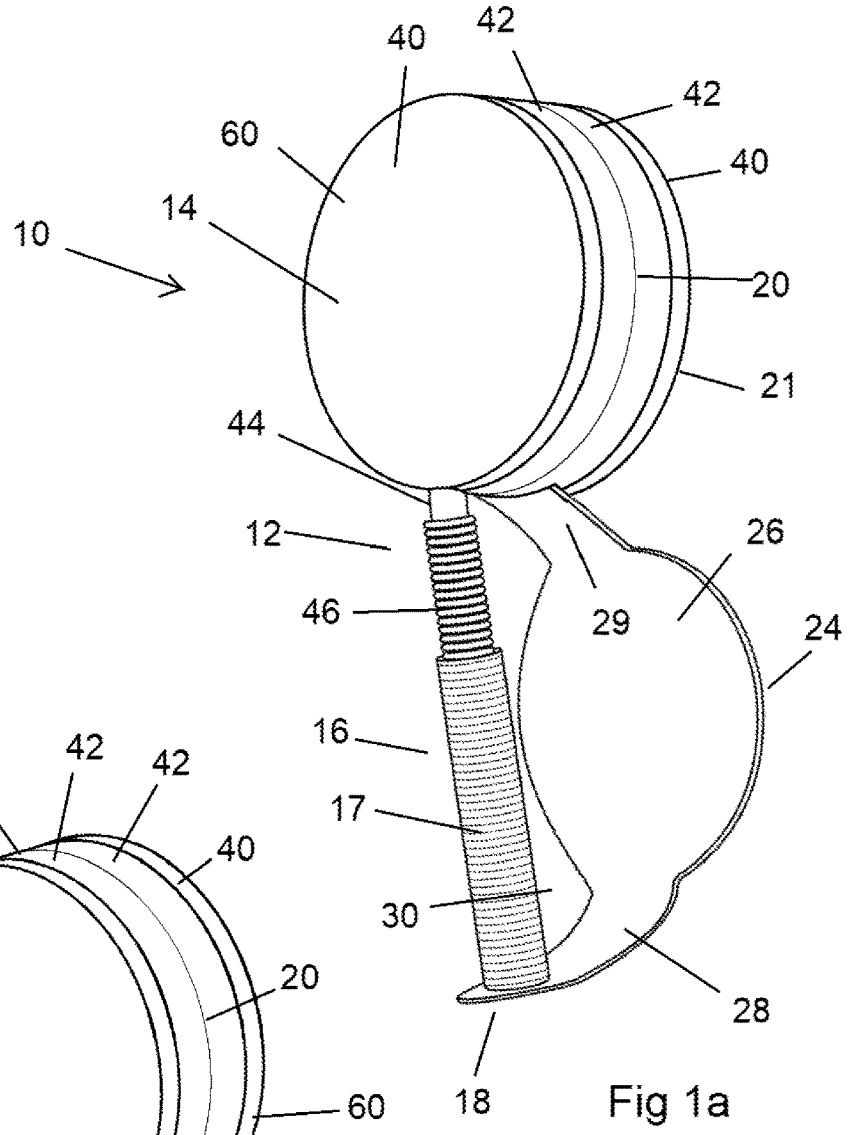
FIG. 1*a* is a rear perspective view of a training pad in accordance with the present invention.
Figure 1B:
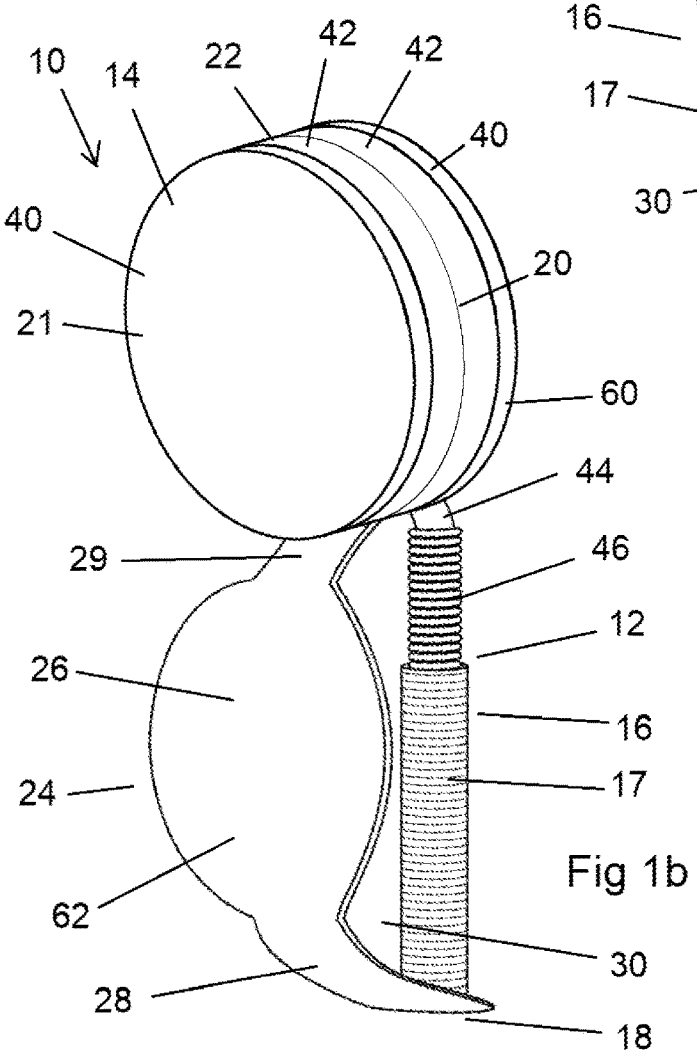
FIG. 1*b* is a front perspective view of the training pad of FIG. 1*a;*
Figure 2:
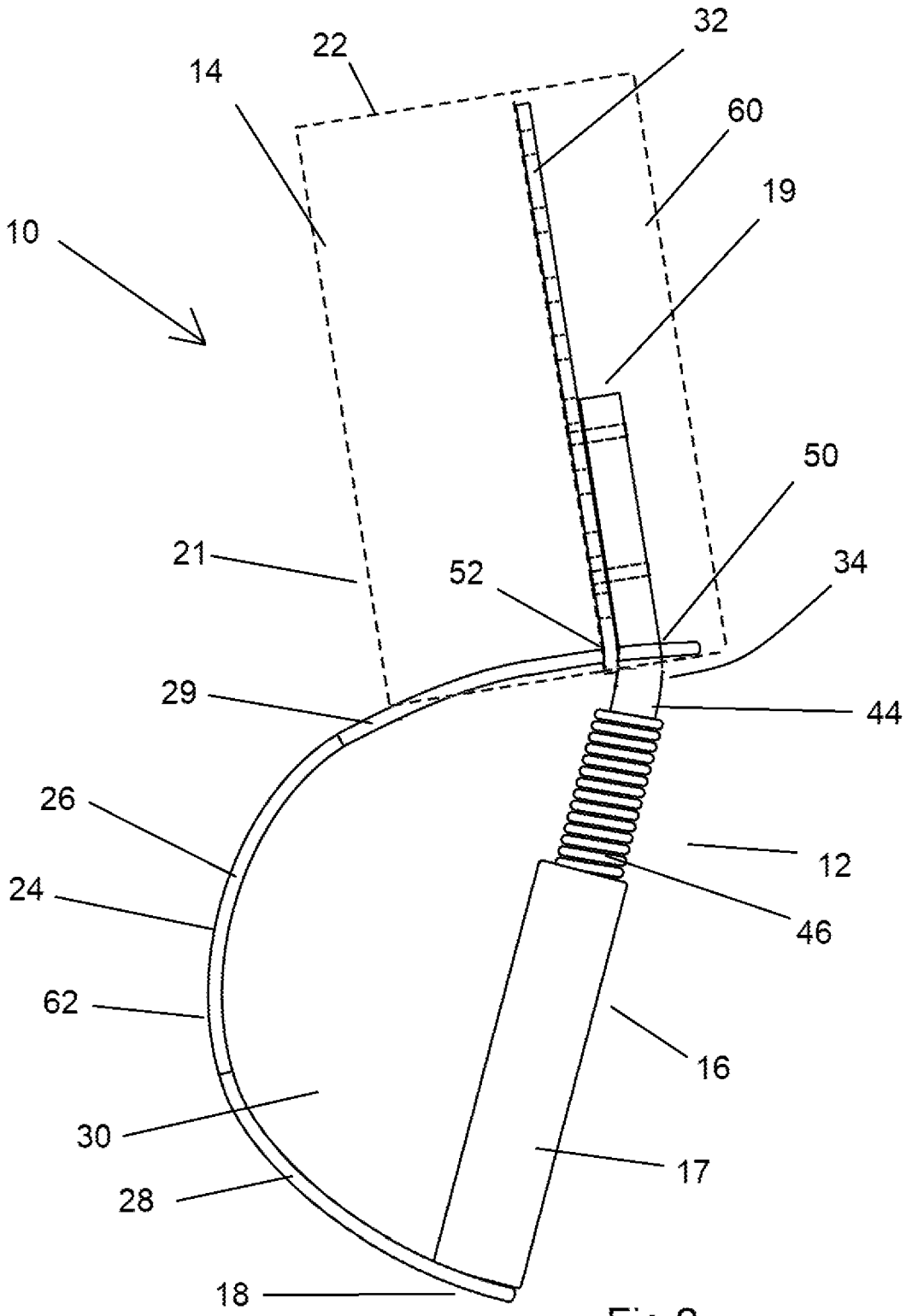
FIG. 2 is a side view of the training pad of FIG. 1.

Referring to the Figures, there is shown a pad 10 comprising generally a shaft 12 and a padded member 14. The shaft 12 comprises an elongate tubular member having a first end 18 and the second end 19. A handle portion 16 is provided on the shaft 14 adjacent the first end 18 of the shaft 12 and the padded member 14 is secured to the shaft 12 adjacent the second end 19.

The padded member 14 comprises a member formed from one or more layers of a suitable flexible material, such as foam and/or rubber. The padded member 14 includes a generally planar first side surface 20, a generally planar second side surface 21 and an edge surface 22 extending between the first and second side surfaces 20 and 21. The shaft 12 of the pad 10 is to be attached to the first side surface 20 of the padded member 14 and the second side surface 21 of the padded member 14 is to be struck with punches in use. In the embodiment shown, the padded member 14 is cylindrical in shape such that the first and second side surfaces 20 and 21 are circular. It will be appreciated however that alternative shapes may be used for the padded member 14.

The shaft 12 includes a plate 32 secured adjacent the second end 19 thereof to support the padded member 14. The plate 32 comprises a planar member secured to the shaft 12 such that the first side surface 21 of the padded member 14 is secured to a first side of the plate 32. The plate 32 has a shape corresponding to that of the padded member 14 and so, in the embodiment shown, the plate 32 is therefore circular in shape. The plate 32 in the embodiment shown extends outwardly beyond the second end 19 of the shaft 12.

The padded member 14 comprises one or more layers of suitable material. In the embodiment shown, there is provide an outer layer 40 adjacent the second side surface 21 and an inner layer 42 secured to the plate 32. The outer layer 40 may be formed of a suitable rubber material and the inner layer 42 from a suitable foam material. It will be appreciated though that other constructions would be possible in order to provide suitable impact absorbing properties.

The training pad 10 is also provided with a rear pad 60. The rear pad 60 is secured to a second side of the plate 32. The rear pad 60 may also comprise an outer layer 40 located remote from the plate 32 and an inner layer 42 secured to the plate 32. The rear pad 60 is also circular in the embodiment shown and is provided to provide protection should the second end 19 of the training pad 10 be forced backwardly during use towards the trainer.

An outer cover (not shown) may also be provided extending over the padded member 14 and the rear pad 60.

The handle portion 16 is provided adjacent the first end 18 of the shaft 12 such that a trainer may grip the training pad 10 by the handle portion 16. In the embodiment shown, the handle portion 16 includes a handgrip 17 into which the first end 18 of the shaft 12 is received. The handgrip 17 comprises a common flexible grip formed from a suitable material, such as a flexible rubber or plastic material having ribbing to allow the pad 10 to be easily held by the handgrip 17.

The shaft 12 comprises a rod 44 and a spring 46. The spring 46 forms a portion of the shaft 12 adjacent the first end 18 and the rod 44 forms a portion of the shaft 12 adjacent the second end 19. A first end of the spring 44 therefore extends from the first end 18 of the shaft to a second end of the spring 44 located between the first and second ends 18 and 19 of the shaft 12. A first end of the rod 46 is received into the second end of the spring 44 and the rod 46 extends to the second end 19 of the shaft 19. The rod 46 is formed from a suitable resilient material, such as a plastic material. The spring 46 in the embodiment shown comprises the handle portion 16.

The rod 46 includes a bend 34 located on a side of the padded member 14 adjacent the spring 46. The portion of the rod 46 from the bend 34 to the first end 18 is bent in a direction towards the second side surface 21 of the padded member 14.

The training pad 10 includes also a guard 24. The guard 24 extends from the first end 18 of the shaft 12 to a location on a side of the handle portion 16 adjacent the padded member 14. The guard 24 comprises a curved member formed from a flexible resilient material, such as a planar sheet of plastic material. The guard 24 is curved such that the guard 24 forms a convex outer surface 62 facing away from the handle portion 16.

The guard 24 may also include a padded cover (not shown) across the outer surface of the shield portion 26. The padded cover would provide additional protection against impact against the outer surface of the guard 24. The padded cover may also extend across an inner surface of the guard 24 adjacent the trainer's hand in use.

The guard 24 comprises, in the embodiment shown, a shield portion 26, a first support 28 and a second support 29. The shield portion 26 comprises a planar member to be supported adjacent a front side of the handle portion 16 (being the side of the shaft 12 on which the padded member 14 is secured) such that a gap 30 is defined between the shield portion 26 and the handle 16. The first support 28 extends from a first end of the shield portion 26 to secure to the first end 18 of the shaft 12. The second support 29 extends from a second end of the shield portion 26 to engage with the shaft 12 on a side of the handle portion 16 adjacent the padded member 14.

Figure 3:
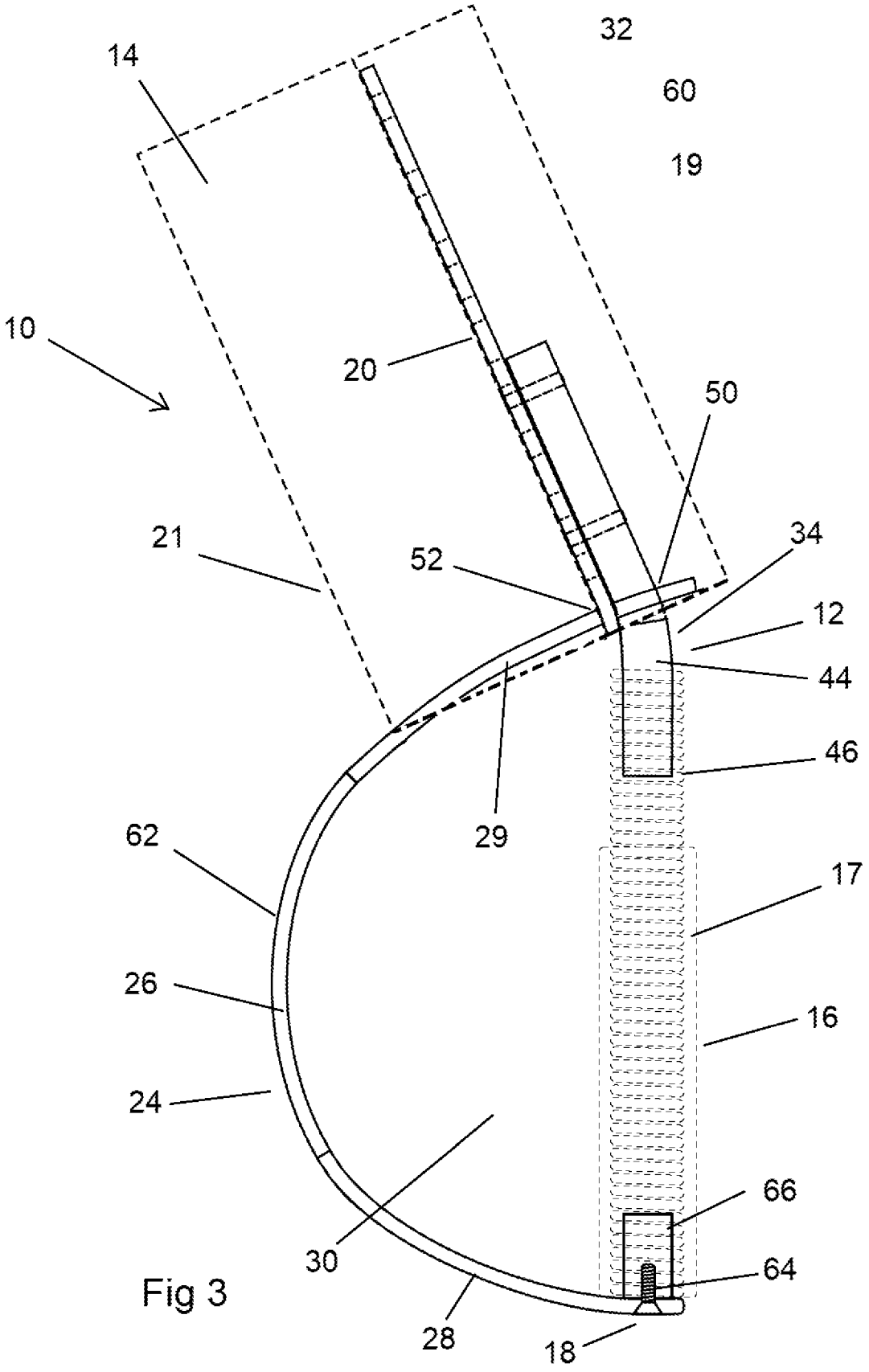
FIG. 3 is a side view of the training pad of FIG. 1 showing internal features of the handle portion.

The first support 28 in the embodiment shown comprises an elongate planar member extending at an angle to the shield portion 26 to a position adjacent the first end 18 of the shaft 12. A distal end of the first support 28 is secured to the first end 18 of the shaft 12 by an appropriate fastener, such as a threaded fastener 64. The threaded fastener 64 is screwed into a plug 66 received into an end of the spring 46, as can be seen in FIG. 3.

The second support 29 also comprises an elongate planar member extending at an angle to the shield portion 26 from a second end thereof to be adjacent the shaft 12. In the embodiment shown, the shield portion 26 and the first and second supports 28 and 29 are integrally formed from a sheet of suitable material, such as a resilient plastic sheet material.

Figure 4A:
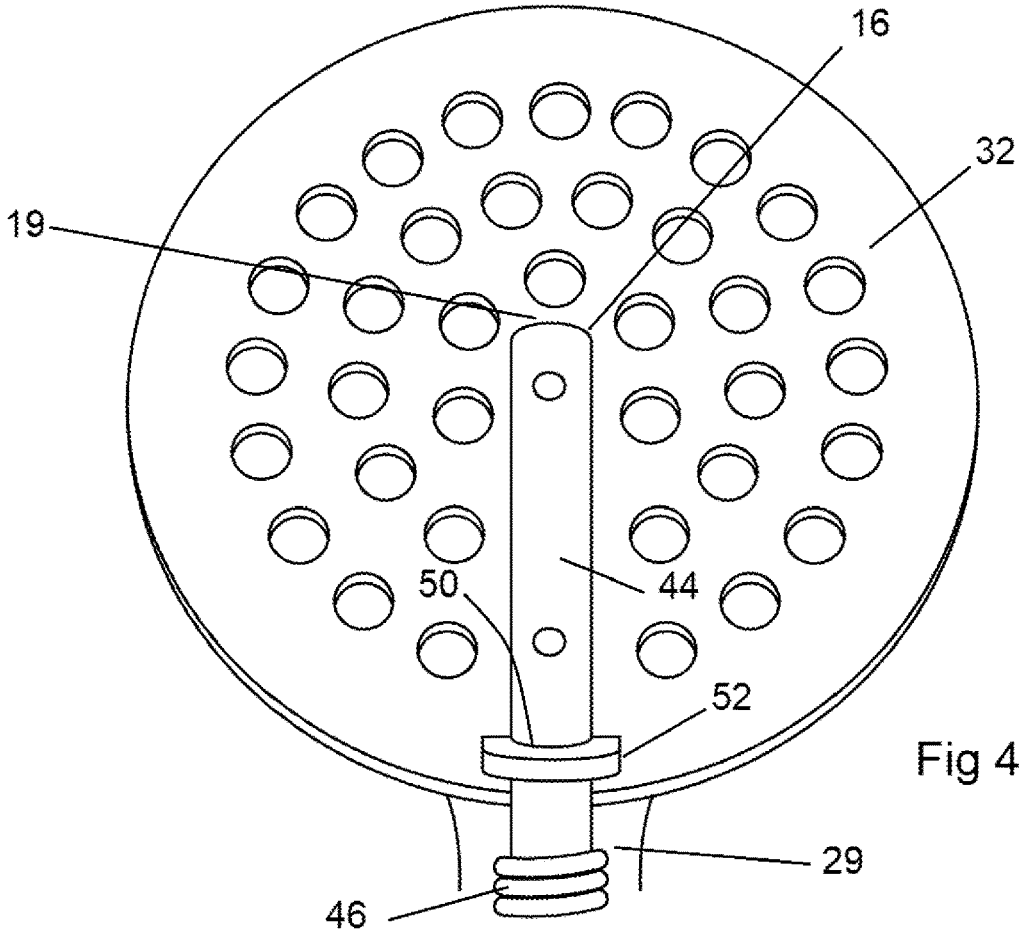
FIG. 4*a* is a rear view showing connection of the guard to the shaft.
Figure 4B:
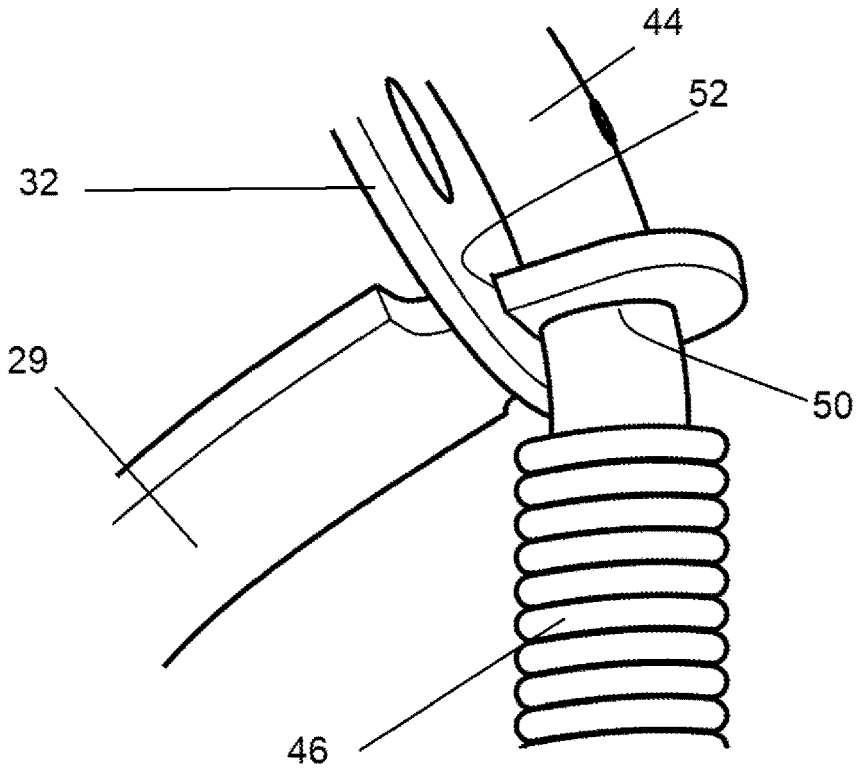
FIG. 4*b* is a perspective view showing the connection between the guard and the shaft.
Figure 5:
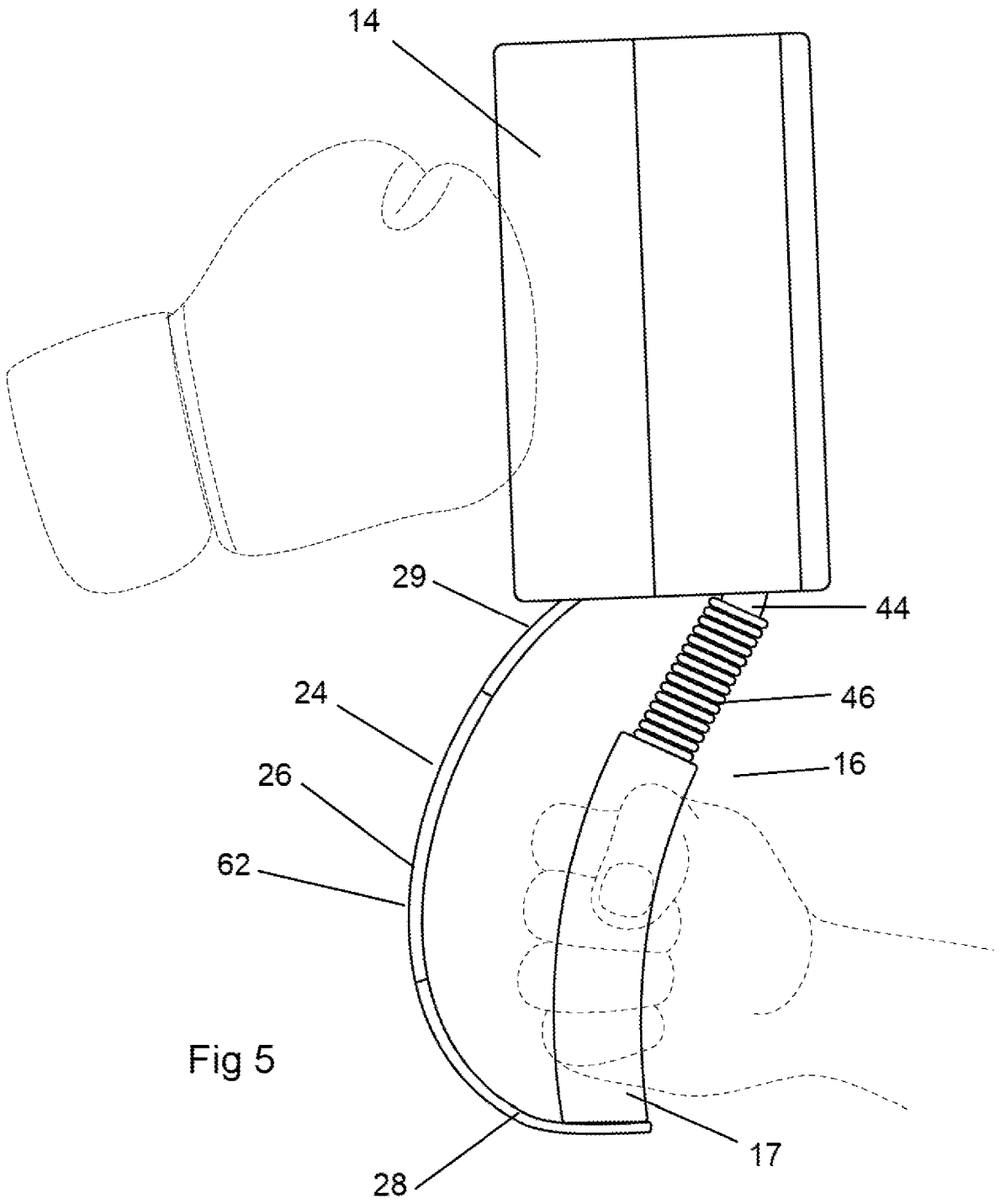
FIG. 5 is a side view showing flexing of the training pad during use.

The distal end of the second support 29 of the guard 24 includes an opening 50 which receives the shaft 12 in order to connect the second support 29 to the shaft 12. As can be seen in FIG. 4, the plate 32 includes a slot 52 such that the distal end of the second support 29 passes through the slot 52. The guard 24 is thereby connected to both the plate 32 and the shaft 12. This provides a secure connection for the guard 24 while allowing relative flexing of the guard 24, the plate 32 and the rod 44 of the shaft 12 during impact, as shown in FIG. 5.

In use, the pad 10 may be gripped by the handle 16 such that the hand of the trainer passes through the gap 30 defined between the shield portion 26 and the handgrip 17. The pad 10 is held by the user in front of them such that second side surface 21 is directed towards the trainee. The trainee may then punch the second side surface 21 of the padded member 14 under the direction of the trainer. The hand of the trainer is protected by the shield portion 26 of the guard 24 such that should the trainee miss a strike against the padded member 14, the trainee will not impact the hand of the trainer.

The construction of the training pad 10 therefore protects the hands of the trainer. Should a punch strike the outer surface 62 of the guard 24, the guard 24 will flex in order to protect both the hand of the person punching and the hand of the trainer. The flexing of the spring 46 forming the handle portion 16 also allows additional flexing of the guard 24 to further reduce the impact of the blow, thereby protecting both the hand of the trainee and the trainer. The flexing of the spring also generally reduces the force absorbed by the arm of the trainer to reduce the likelihood of arm and shoulder injury. The curved arrangement of the outer surface 62 also directs blows to slide along the guard 24, reducing the force of impact.

It will be readily apparent to persons skilled in the relevant arts that various modifications and improvements may be made to the foregoing embodiments, in addition to those already described, without departing from the basic inventive concepts of the present invention.

The invention claimed is:

1. A training pad comprising:

a flexible resilient shaft having a first end and a second end;

a handle portion provided adjacent the first end of the flexible resilient shaft;

a padded member mounted adjacent the second end of the flexible resilient shaft; and a guard having a first end connected to the first end of the flexible resilient shaft and a second end connected to the flexible resilient shaft on a side of the handle portion adjacent the padded member;

wherein the guard comprises a flexible resilient member being curved between the first and second ends thereof such that the guard defines a convex outer surface supported in front of the handle portion.

2. The training pad according to claim 1, wherein the flexible resilient shaft comprises a spring and a rod received into an end of the spring, the spring including a handgrip such that the spring and the handgrip form the handle portion.

3. The training pad according to claim 2, wherein the padded member includes a first side surface adjacent the flexible resilient shaft and a second side surface configured to be struck with blows in use and the rod includes a bend located on a side of the padded member adjacent the spring such that a portion of the flexible resilient shaft from the bend to the first end is bent in a direction towards the second side surface.

4. The training pad according to claim 3, wherein a plate is connected to the rod such that the first side surface of the padded member is connected to the plate.

5. The training pad according to claim 4, wherein the second end of the guard includes a hole through which the flexible resilient shaft is received and the plate includes a slot on a side adjacent the handle portion such that the second end of the guard passes through the slot.

6. The training pad according to claim 1, wherein the guard comprises a shield portion located in front of the handle portion, a first support extending from the shield portion to connect to the first end of the flexible resilient shaft and a second support extending from the shield portion to connect to the flexible resilient shaft adjacent the padded member.

7. The training pad according to claim 6, wherein the first support comprises an elongate planar member extending at an angle to the shield portion to a position adjacent the first end of the flexible resilient shaft such that a distal end of the first support is secured to the first end the flexible resilient shaft by a fastener received into a plug provided in an end of the spring.

8. The training pad according to claim 7, wherein the second support comprises an elongate planar member extending at an angle to the shield portion from a second end thereof to be adjacent the flexible resilient shaft.

9. The training pad according to claim 8, wherein the shield portion and the first and second supports are integrally formed.

10. The training pad according to claim 1, wherein the pad includes a rear padded member secured to a second side surface of the plate.

* * * * *